US006312229B1

(12) United States Patent
Popov

(10) Patent No.: US 6,312,229 B1
(45) Date of Patent: Nov. 6, 2001

(54) METHOD FOR OPERATING A PUMPING-EJECTION APPARATUS AND APPARATUS FOR REALISING SAID METHOD

(75) Inventor: Serguei A. Popov, 4615 Post Oak Pl., Suite 140, Houston, TX (US) 77027

(73) Assignees: Evgueni D. Petroukhine, Limassol (CR); Serguei A. Popov, Budapest (HU)

( * ) Notice: Subject to any disclaimer, the term of this patent is extended or adjusted under 35 U.S.C. 154(b) by 0 days.

(21) Appl. No.: 09/446,539

(22) PCT Filed: Apr. 26, 1999

(86) PCT No.: PCT/IB99/00745

§ 371 Date: Dec. 27, 1999

§ 102(e) Date: Dec. 27, 1999

(87) PCT Pub. No.: WO99/56023

PCT Pub. Date: Nov. 4, 1999

(30) Foreign Application Priority Data

Apr. 27, 1998 (RU) ..... 98107874

(51) Int. Cl.[7] ..... F04B 23/04

(52) U.S. Cl. ..... 417/77; 417/87; 417/151; 417/158

(58) Field of Search ..... 417/77, 87, 88, 417/151, 158, 196; 62/500

(56) References Cited

U.S. PATENT DOCUMENTS 2,000,741 * 5/1935 Buckland ..... 417/151
2,280,447 * 4/1942 Pearce, Jr. ..... 417/158
2,375,180 * 5/1945 Vigo ..... 417/151

FOREIGN PATENT DOCUMENTS 1050498 8/1959 (DE) .
56-50300 A * 5/1981 (JP) ..... 417/77
2016268 7/1994 (RU) .
2073123 2/1997 (RU) .
2091117 9/1997 (RU) .
559098 7/1977 (SU) .
1733714 5/1992 (SU) .

OTHER PUBLICATIONS

Sokolov E. Y., Zinger N. M., "Jet apparatuses" book, 1970, USSR, Moscow, "Energy" Publishing house, pp. 214–215.

* cited by examiner

*Primary Examiner*—Cheryl J. Tyler
(74) *Attorney, Agent, or Firm*—Mark A. Oathout

(57) ABSTRACT

The introduced process essentially includes feeding a gas-liquid flow from a liquid-gas ejector into a hydrodynamic device for adjusting the flow speed, where the gas-liquid flow is exposed to an expansion and hence a subsonic flow regime is provided. The introduced process is implemented by a pumping-ejector unit furnished with a hydrodynamic device for adjusting the flow speed. An inlet of this device is connected to an outlet of a liquid-gas ejector, an outlet of the device is connected to a separator. The hydrodynamic device defines a profiled canal diverging in the flow direction or a collection of divergent canals arranged one after another in series. The described operating process and related pumping-ejector unit ensure a more reliable and efficient operation.

4 Claims, 2 Drawing Sheets

METHOD FOR OPERATING A PUMPING-EJECTION APPARATUS AND APPARATUS FOR REALISING SAID METHOD

BACKGROUND

The present invention pertains to the field of jet technology, primarily to pumping-ejector units for producing a vacuum and for compression of gaseous mediums.

An operating process of a pumping-ejector system is known, which consists of feeding a liquid medium under pressure into a nozzle of a liquid-gas ejector by a pump, forming of a liquid jet at the outlet of the nozzle, evacuation of a gaseous medium by this jet, mixing of the liquid medium and the gaseous medium, forming a gas-liquid stream and subsequent discharge of the stream from the ejector into drainage (see "Jet Apparatuses", book of E. Y. Sokolov, N. M. Zinger, "Energia" Publishing house, Moscow, 1970, pages 214–215).

The same book also introduces a pumping-ejector system including a pump and a liquid-gas ejector, where the pump is connected through its discharge side to the ejector nozzle, the passive gaseous medium inlet of the ejector is connected to a source of an evacuated medium and the ejector outlet is connected to drainage.

The described operating process and system for its embodiment have not experienced wide industrial application because discharge of the gas-liquid mixture into sewage often results in environmental pollution. In addition, operation of the system requires the high consumption of a liquid medium. The latter makes such systems economically unattractive.

The closest analogue of the operating process introduced by the present invention is an operating process of a pumping-ejector unit, which includes delivery of a motive liquid medium from a separator to at least one nozzle of a liquid-gas ejector by a pump, evacuating a gaseous medium by a jet of the motive medium, mixing of the mediums and forming of a gas-liquid flow in the ejector with simultaneous compression of the gaseous medium (see RU, patent, 2091117, cl. B 01 D 3/10, 1997).

The same RU patent No. 2091117 also describes a pumping-ejector unit for embodiment of the process. It includes a separator, a pump and a liquid-gas ejector. The liquid inlet of the ejector is connected to the discharge side of the pump and the gas inlet of the ejector is connected to a source of an evacuated gaseous medium.

With the operating process and related pumping-ejector unit it is possible to reduce energy consumption because the liquid-gas ejector is placed at a height of 5 to 35 meters above the separator and thus provides utilization of gravitational force in the delivery pipe connecting the ejector and the separator.

But together with this positive effect such a design also has a significant imperfection concerned with the fact, that the high altitude position of the jet apparatus and the long delivery pipe provoke a jump in the gas-liquid flow speed in the delivery pipe. As a result, the speed of the gas-liquid flow at the separator inlet, where a hydroseal is made, can reach hundreds of meters per second. Therefore there is a necessity to reinforce those elements of the separator which react to the increased load generated by the high-speed flow. This leads to an increase in the separator dimensions and specific consumption of materials.

SUMMARY OF THE INVENTION

The present invention is aimed at improving reliability of a pumping-ejector unit, which can be achieved by adjusting the flow speed at the inlet of a separator regardless of spatial positioning of a liquid-gas ejector (horizontal or vertical) and regardless of the ejector altitude above the separator.

The solution of the above mentioned problem is provided by an operating process of a pumping-ejector unit, which includes delivery of a liquid motive medium from a separator to at least one nozzle of a liquid-gas ejector by a pump, evacuating a gaseous medium by a jet of the motive medium flowing from the ejector nozzle(s), mixing of the mediums in the ejector and forming a gas-liquid flow with simultaneous compression of the gaseous medium, feeding the gas-liquid flow from the ejector into a hydrodynamic device for adjusting the flow speed, deceleration of the gas-liquid flow in the hydrodynamic device to a subsonic speed due to a controllable enlargement of a flow-through canal of the device and subsequent feeding of the decelerated gas-liquid flow into the separator, where compressed gas is separated from the liquid motive medium.

With regard to the apparatus as the subject-matter of the invention, the mentioned technical problem is solved as follows: a pumping-ejector unit including a separator, a pump connected through its suction side to the separator, and a liquid-gas ejector, whose liquid inlet is connected to the discharge side of the pump and whose gas inlet is connected to a source of an evacuated gaseous medium, is furnished with a hydrodynamic device for adjusting the flow speed. The device can be composed of one or several portions joined in series, where each portion represents a canal diverging in the flow direction. An inlet of the hydrodynamic device is connected to the ejector outlet, an outlet of the device is connected to the separator. The surface area of the outlet cross-section of each divergent canal of the device is from 4.0 to 50 times larger than the surface area of its inlet cross-section. The length of each divergent canal of the device is not less than $1.36\sqrt{S}$, where S is the surface area of the outlet cross-section of this divergent canal.

The inlet of the hydrodynamic device for adjusting the flow speed can be fastened directly to the outlet section of the ejector, the outlet of the hydrodynamic device can be fastened directly to the separator inlet.

The pipes connecting the inlet and the outlet of the hydrodynamic device (for adjusting the flow speed) to the ejector outlet and the separator inlet (if any) can have a uniform section, or they can be convergent with a taper angle of up to 26° or divergent with a taper angle of up to 5–6°. With regard to the shape of the cross-sections of the divergent canals of the hydrodynamic device and the cross-sections of the pipes, their shape has no vital importance and can be, for example, circular, oval, polyhedral etc.

It has been discovered that backpressure at the outlet of a liquid-gas ejector exerts a significant influence on the performance of the ejector. Therefore it is necessary to ensure deceleration of the flow prior to its entry into the separator without a significant increase in backpressure.

It was found that the most successful way to achieve same is to use energy of the gas-liquid flow itself for the deceleration of the flow and to make the deceleration system easy to control. Additionally, it is essential to impart a feedback feature to the deceleration system, i.e. to provide the ability to adjust the operating mode of the ejector by varying pressure, for example, in the separator. It was also found to be important to provide such conditions under which the flow passes from the outlet of the liquid-gas ejector to the inlet of the separator at a subsonic speed.

In a number of cases, for example when the ejector is installed vertically at a relatively high altitude above the separator, it is expedient to compose the hydrodynamic device for adjusting the flow speed with several divergent canals arranged one after another in series. It was discovered that, in such cases, the built-up hydrodynamic device operates better than a hydrodynamic device composed of a single canal with a significant enlargement, which can not provide deceleration of the flow to the permissible speed ranging from 4.6 to 450 m/sec. In connection with this, it is not expedient to make the divergent canal or canals with a ratio of the surface area of the outlet cross-section to the surface area of the inlet cross-section more than 50 and less than 4.0. The length of each canal must not be less than 1.36 $\sqrt{S}$, where S is the surface area of the outlet cross-section of the canal.

As to the location of the divergent canals of the hydrodynamic device, it is advisable to place the canals evenly between the ejector outlet and the separator inlet. But when the ejector is installed at a low level or when the unit has a horizontal layout, it is advisable to install the hydrodynamic device directly at the ejector outlet or at the separator inlet.

Thus, the described unit implementing the introduced operating process provides a solution to the stated technical problem, i.e. it exhibits an increased reliability because in this unit a gas-liquid flow is delivered from a liquid-gas ejector into a separator at a predetermined speed.

DESCRIPTION OF THE PREFERRED EMBODIMENTS

Figure 1:
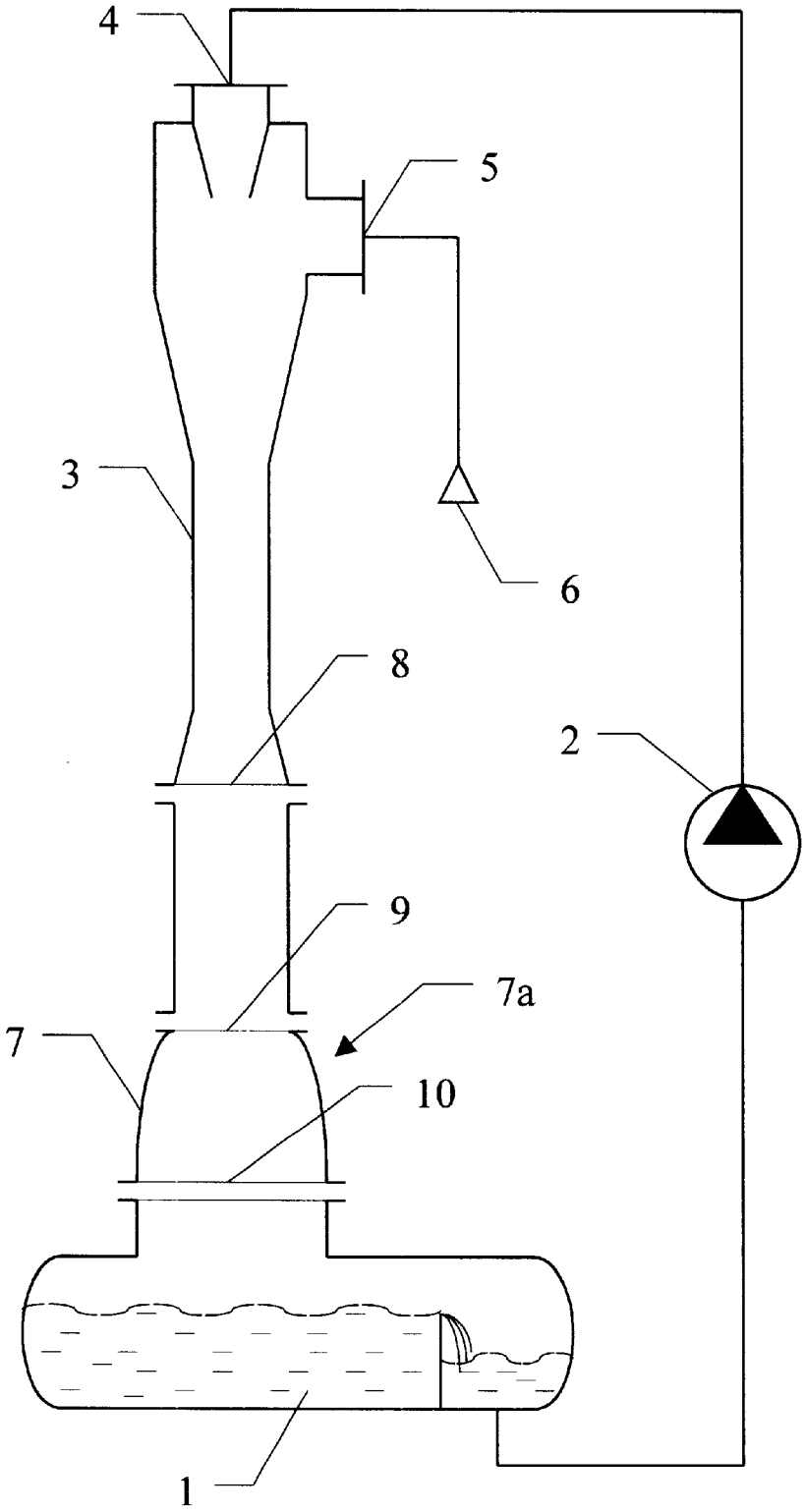
FIG. 1 represents a schematic diagram of a pumping-ejector unit with a single-nozzle ejector, a separator and a hydrodynamic device for adjusting the flow speed placed at some distance from both the ejector and the separator.

The pumping-ejector unit (FIG. 1) includes a separator 1, a pump 2 whose suction side is connected to the separator 1, and a single-nozzle liquid-gas ejector 3 whose liquid inlet 4 is connected to the discharge side of the pump 2 and whose gas inlet 5 is connected to a source 6 of an evacuated gaseous medium. The pumping-ejector unit is furnished with a hydrodynamic device 7*a* for adjusting the flow speed, which defines a canal 7 diverging in the direction of a gas-liquid flow. An inlet 9 of the canal 7 is connected to an outlet 8 of the ejector, an outlet 10 of the canal 7 is connected to the separator 1. The canal 7 can be formed by a conical surface, by a collection of stepwise diverging canals or by a surface with a curved or broken generating line.

The inlet 9 of the canal 7 can be fastened directly to the outlet 8 of the ejector mixing chamber or ejector diffuser—subject to the ejector design. The outlet 10 of the canal 7 can be fastened directly to the inlet of the separator 1.

Figure 2:
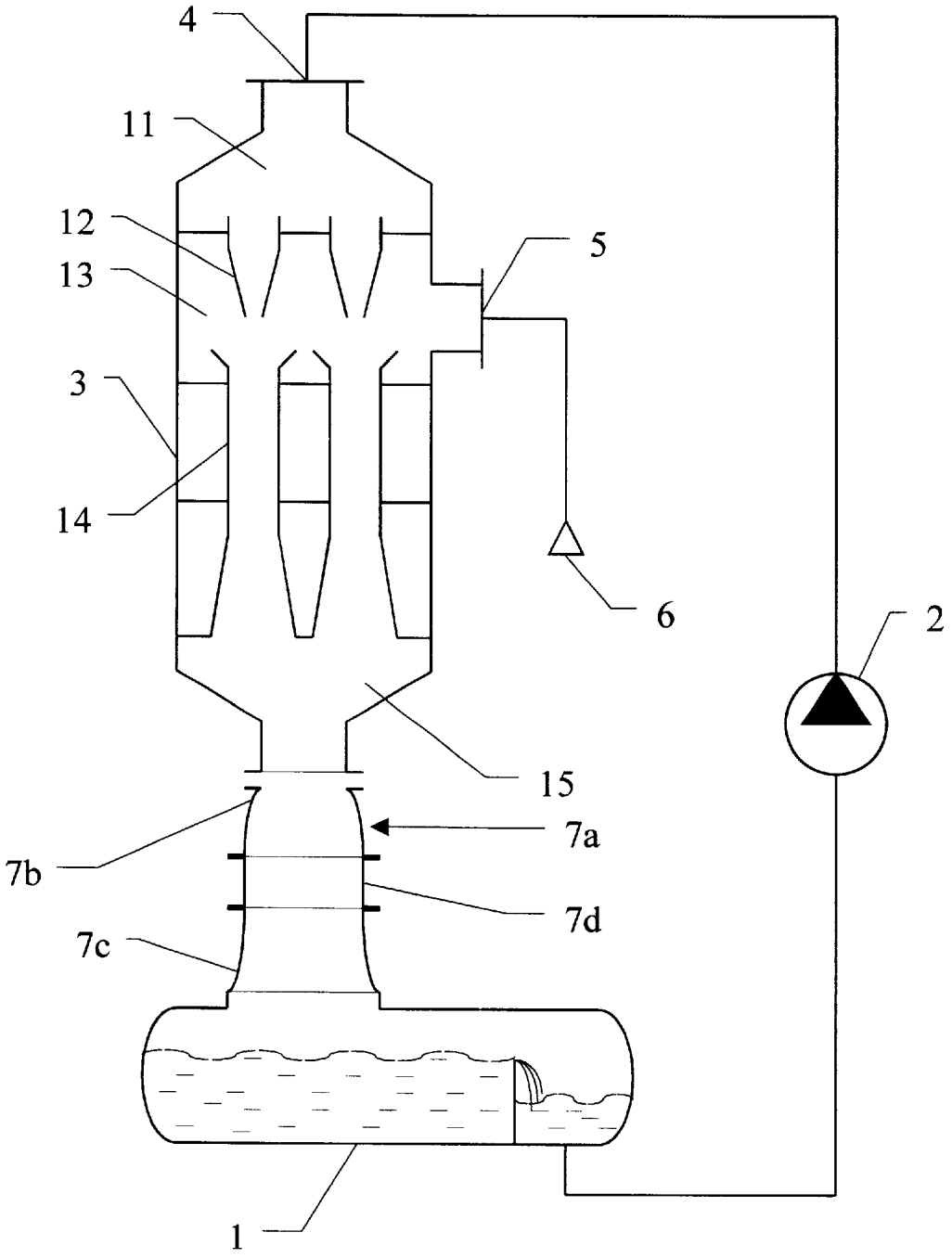
FIG. 2 represents a schematic diagram of a pumping-ejector unit with a multi-nozzle liquid-gas ejector and with a hydrodynamic device for adjusting the flow speed placed directly at the outlet of the ejector discharge chamber.

Another embodiment of the pumping ejector unit differs from the above described one as follows: the pumping ejector unit is furnished with a multi-nozzle liquid-gas ejector 3 (FIG. 2). In this case the ejector 3 includes a chamber 11 for motive liquid distribution with active nozzles 12 installed at the outlet from the chamber 11, a receiving chamber 13 and mixing chambers 14 installed coaxially to each nozzle 12.

The multi-nozzle ejector 3 can be furnished with a discharge chamber 15 installed at the outlet of mixing chambers 14. In this case (see FIG. 2) an inlet of the hydrodynamic device 7*a* for adjustment of the flow speed can be fastened directly to the outlet of the discharge chamber 15 of the multi-nozzle ejector 3.

As for the hydrodynamic device 7*a* itself, it may include—in contrast to the device in FIG. 1—several canals 7 (e.g. 7*b*, 7*c* shown) placed one after another in series. For each canal 7 the ratio of the surface area of the outlet cross-section of the canal 7 to the surface area of the inlet cross-section of this canal 7 must range from 4.0 to 50, the length (from inlet to outlet) of each canal 7 should not be less than 1.36 $\sqrt{S}$, where S is the surface area of the outlet cross-section of the canal 7.

The operating process of the pumping-ejector unit is realized as follows.

A liquid motive medium from the separator 1 is delivered into the nozzle of the ejector 3 through its liquid inlet 4. The liquid motive medium flowing out of the nozzle evacuates a gaseous medium and mixes with the gaseous medium. Thus a gas-liquid flow is formed in the mixing chamber of the ejector 3. At the same time the evacuated gaseous medium undergoes compression due to energy transfer from the motive liquid. The liquid-gas medium from the ejector 3 flows into the canal 7 of the hydrodynamic device 7*a* for adjusting the flow speed, where the flow is exposed to an expansion. The expansion takes place because the gas-liquid flow completely occupies the entire volume of the divergent canal 7. Thus a subsonic flow regime is ensured due to such expansion of the gas-liquid flow. The flow is decelerated to a designed speed which ranges as a rule from 4.6 to 450 m/sec. It is necessary to note that the gas-liquid flow is additionally compressed during the deceleration in the canal 7. This additional compression intensifies condensation of condensable components of the gas-liquid flow. Then the gas-liquid flow passes to the separator 1, where compressed gas is separated from the motive liquid.

The difference in operation of the pumping ejector unit with the multi-nozzle ejector 3 consists of the following: the liquid motive medium is fed through the distribution chamber 11 simultaneously into several nozzles 12. Jets of the motive liquid formed by the nozzles 12 flow into the separate mixing chambers 14 (each aligned with a corresponding nozzle 12). Gas-liquid streams from the mixing chambers 14 are collected in the discharge chamber 15. In contrast to the pumping ejector unit of FIG. 1 adjustment of the flow speed in the unit of FIG. 2 takes place in several canals 7 of the hydrodynamic device 7*a*. Such an arrangement of the canals 7 is expedient for when the gas-liquid flow permanently gathers speed, for example under the force of gravity. In this case after leaving the discharge chamber 15 the gas-liquid flow is decelerated in the first canal 7*b*, then the flow moves for example through a vertical cylindrical pipe 7*d*, where it is accelerated under gravity up to a near-sonic speed. Next, this flow enters the second canal 7*c*, where it is decelerated again. If necessary, this deceleration process is repeated several times in order to provide a subsonic flow regime of the gas-liquid flow (i.e. a flow regime in which the flow velocity is less than the speed of sound in this flow) at the inlet of the separator 1.

INDUSTRIAL APPLICABILITY

The present invention can be applied in chemical, petrochemical and other industries.

What is claimed is:

1. An operational process for a pumping-ejector unit, comprising the steps of:

feeding a liquid motive medium from a separator into at least one nozzle of a liquid-gas ejector by a pump;

evacuating a gaseous medium by at least one jet of the liquid motive medium;

forming a gas-liquid flow in the liquid-gas ejector and simultaneously compressing the gaseous medium;

feeding the gas-liquid flow from the liquid-gas ejector into a hydrodynamic device for adjusting flow speed, including decelerating the gas-liquid flow in the hydrodynamic device to a subsonic speed by controllably enlarging a flow-through canal defined by the hydrodynamic device and expanding the gas-liquid medium in the hydrodynamic device; and feeding the decelerated gas-liquid flow into the separator, where a compressed gas is separated from the liquid motive medium.

2. A pumping-ejector unit, comprising:

a separator;

a pump connected by a suction side to the separator;

a liquid-gas ejector connected by a liquid inlet to a discharge side of the pump and connected by a gas inlet to a source of an evacuated gaseous medium;

a hydrodynamic device for adjusting flow speed having an inlet connected to an outlet from the liquid-gas ejector, and having an outlet connected to the separator; and wherein said hydrodynamic device defines at least one canal diverging in a flow direction, wherein the cross-sectional area of an outlet from said canal diverging in the flow direction is from 4.0 to 50 times larger than the cross-sectional area of an inlet to said canal diverging in the flow direction, and wherein the length of said canal diverging in the flow direction is not less than $1.36\sqrt{S}$.

3. The pumping-ejector unit according to claim 2, wherein said hydrodynamic device is fastened directly to the outlet from the liquid-gas ejector.

4. The pumping-ejector unit according to claim 2, wherein the outlet of said hydrodynamic device is fastened directly to an inlet of the separator.

* * * * *